US005365040A

United States Patent [19]

Oka

[11] Patent Number: 5,365,040

[45] Date of Patent: Nov. 15, 1994

[54] FIXING DEVICE HAVING A TEMPERATURE CONTROL SYSTEM

[75] Inventor: Tateki Oka, Atsugi, Japan

[73] Assignee: Minolta Co., Ltd., Osaka, Japan

[21] Appl. No.: 927,116

[22] Filed: Aug. 7, 1992

[30] Foreign Application Priority Data

Aug. 9, 1991 [JP] Japan ..... 3-200806

[51] Int. Cl.[5] ..... H05B 1/02

[52] U.S. Cl. ..... 219/497; 219/492; 219/505; 219/216; 307/117

[58] Field of Search ..... 219/216, 492, 493, 497, 219/499, 501, 505, 508; 307/117; 340/588, 589

[56] References Cited

U.S. PATENT DOCUMENTS

| | | | |
|---|---|---|---|
| 4,420,113 | 12/1983 | Lacroix | 219/497 |
| 4,495,405 | 1/1985 | Foster | 219/497 |
| 4,554,439 | 11/1985 | Cross et al. | 219/497 |
| 4,614,860 | 9/1986 | Kativois | 219/501 |
| 4,968,872 | 11/1990 | Kusumoto | 219/497 |
| 5,179,263 | 1/1993 | Koh et al. | 219/216 |

FOREIGN PATENT DOCUMENTS 56-123005 9/1981 Japan .

*Primary Examiner*—Mark H. Paschall

*Attorney, Agent, or Firm*—Price, Gess & Ubell

[57] ABSTRACT

A fixing device of an image forming apparatus for fixing a toner image on a paper by a heating roller and a pressure roller, and having a detector for detecting the temperature of the heating roller. The fixing device controls to supply the electric current to the heating roller intermediately between on state and off state by repeatedly switching on and off the electric current when the difference between the detection temperature signal detected by the detector and a reference temperature signal is within a predetermined value.

In detail, the fixing device overlays a periodically changing signal on at least one of the detection temperature signal and the reference temperature signal by a signal convertor so as to control the current supplied to the heating roller in accordance with the comparison result of the detection temperature signal and the reference temperature signal output from the signal convertor.

8 Claims, 5 Drawing Sheets

FIXING DEVICE HAVING A TEMPERATURE CONTROL SYSTEM

BACKGROUND OF THE INVENTION

1. Field of the Invention

The present invention relates to a fixing device for use in image forming apparatus such as copying apparatus, laser printers and the like.

2. Description of the Related Art

Conventionally, fixing devices for image forming apparatus are generally known and have the capacity to fuse and fix a toner image as a copy sheet bearing an toner image in an unfixed state passes between a pair of pressure and heating rollers. Control circuits for maintaining the surface temperatures of the aforesaid pair of fixing rollers at predetermined temperatures generally compare the temperature detection signals emitted from temperature detection sensors such as thermistors and the like disposed so as to be in contact with the roller surface with predetermined reference temperature signals used for temperature regulation. The surface temperature of the roller is controlled by turning on an electrical current which is supplied to a heater provided within the roller when the temperature detection signal is less than the reference temperature signal, and by turning off the electrical current flowing to the heater within the roller when the temperature detection signal is greater than the reference temperature signal.

In the aforesaid arrangement, however, a certain amount of time elapses while the heat emitted from the heater within the roller is transmitted to the surface of the roller and, therefore, some time is required for the thermistor to detect the surface temperature and generate a output corresponding to the detected temperature. Accordingly, in the previously described control method, even if the heater is turned on or off, some time delay is produced until the temperature effect of the heater becomes the actual temperature detection signal to be detected, and the time delay causes greater fluctuation in the roller surface temperature in regulating the temperature.

SUMMARY OF THE INVENTION

A main object of the present invention is to provide a fixing device capable of controlling the surface temperature of the fixing rollers while the fluctuation range of the surface temperature.

A further object of the present invention is to provide a fixing device capable of slowing the speed of temperature elevation or reduction when controlling the surface temperature of the fixing rollers.

These and other objects of the present invention are achieved by providing a fixing device for thermally fusing a toner image on a paper sheet by means of a pair of rollers, the fixing device comprising:

heating means for heating the roller, detecting means for detecting the temperature of the roller, signal converting means for overlaying a periodically changing signal on at least one of the temperature detection signal detected by the detecting means and a reference temperature signal which is a standard for roller temperature control, comparing means for comparing the reference temperature signal and the temperature detection signal overlaid the periodically changing signal by the signal converting means, and control means for controlling the current supplied to the heating means in accordance with the comparison results of the comparing means.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
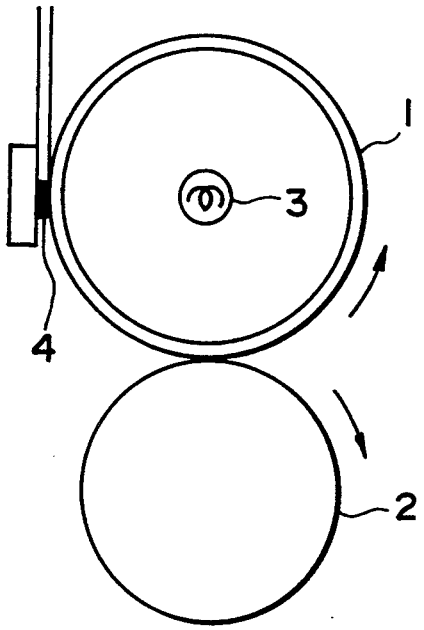
FIG. 1 briefly shows the construction of the fixing device of the present invention.

The preferred embodiments of the present invention are described hereinafter with reference to the accompanying drawings. As shown in FIG. 1, the fixing device of the present embodiment is provided with a heating roller 1 and pressure roller 2 for applying heat to and transporting therebetween a paper sheet bearing a toner image. A heating lamp 3 is provided within the heating roller 1 for heating the roller 1, and a thermistor 4 is disposed so as to be in contact with the surface of the roller 1 to detect the surface temperature of the roller 1. The heating roller 1 rotates with the pressure roller 2 in the arrow direction in the drawing, so as to fix a paper sheet bearing an unfixed toner image formed thereon and being transported from the left side of the drawing and to transport the sheet therebetween toward the right side of the drawing.

Figure 2:
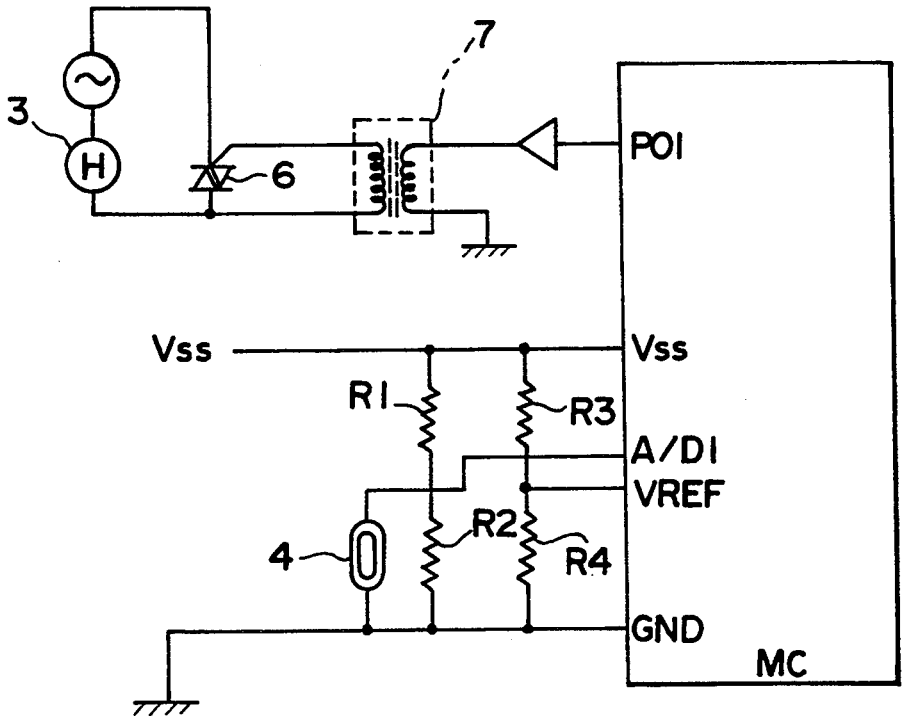
FIG. 2 shows the circuit for controlling the temperature regulating operation of the fixing device of the present invention.

FIG. 2 shows the temperature control circuit of the present embodiment of the fixing device. Temperature control is accomplished by means of a microcomputer MC provided with an analog-to-digital (AD) converter. The heating lamp 3 is connected to an alternative current (AC) power unit via the Triac 6 which is triggered through the transformer 7 by signals from the output port PO1. The thermistor 4 is connected in parallel to the resistor R2 and in series to the resistor R1, and the divided voltages are input to the input port A/D1 of the microcomputer MC as temperature detection signals. The reference temperature signals, which are references for temperature regulation, are input to the VREF from the serially connected resistors R3 and R4. The temperature detection signal input to the A/D1 overlays the square wave having uniform amplitude and periodicity within the microcomputer MC and compared with the reference temperature signal input to the VREF, and a signal is output from the output port PO1 in accordance with the comparison results.

Figure 3:
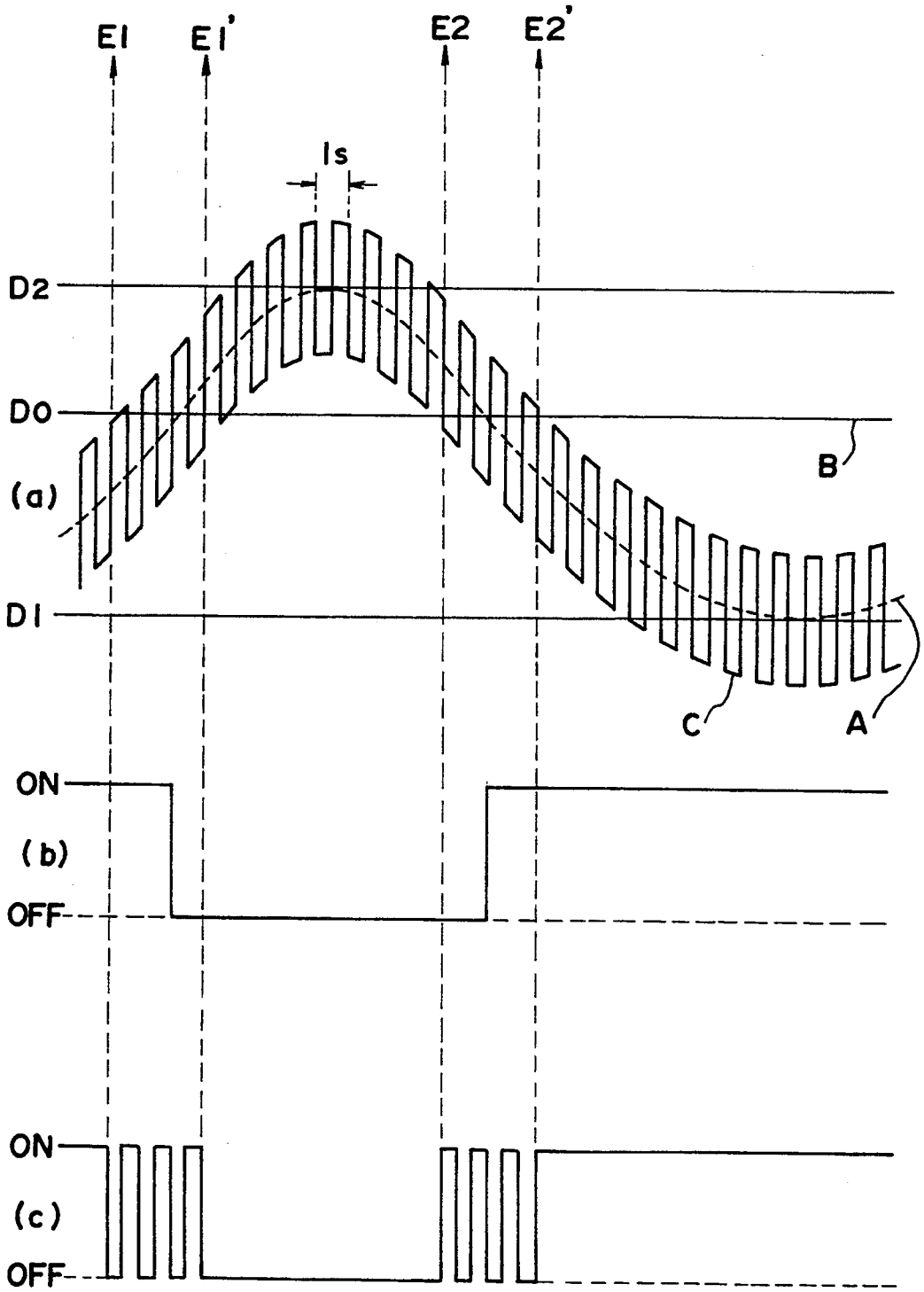
FIG. 3 is an illustration showing the principles of temperature regulation of the fixing device of the present invention.

The control principles for regulating the surface temperature of the heating roller 1 of the present invention are described hereinafter with reference to FIG. 3. The temperature detection signal A detected by the thermistor 4 becomes the temperature detection signal C by adding the square wave having an amplitude of $\Delta T$ (a constant) and a period of 1 [second]. The electric current is controllably turned on and off to the heating lamp 3 by comparing the temperature detection signal C and the reference temperature signal B. More specifically, the surface temperature of the heating roller 1 is elevated by the heating lamp 3, and from the moment the temperature detection signal C intersects the reference temperature signal B at E1 the electric current supplied to the heating lamp 3 is turned off for a time period $\tau 1$, and thereafter is turned on for a time period $\tau 2$, as shown in FIG. 3(*c*). The electric current is supplied intermediately between the on state and the off state by repeating the aforesaid control (i.e., $\tau 1+\tau 2=1$ [second]), and the current is completely turned off at El'. After the electric current is turned off, the surface temperature of the roller 1 shifts downwardly, and the current is again turned on to the heating lamp 3 at the moment the temperature detection signal C again intersects the reference temperature signal B at E2 in the drawing. Within the region E2~E2'the electric current is supplied intermediately between the on state and the off state by repeatedly switching on and off the electric current supplied to the heating lamp 3 in the same manner as within the range El~E1', then the current is completely turned on.

That is, when the heating lamp 3 is in the on state and the detected temperature approaches a set reference temperature from a lower temperature, the current supplied to the heating lamp 3 is controllably turned on and off for periods of 1 [second], as shown in FIG. 3(*c*), so as to reduce power consumption and retard the speed at which the temperature is elevated. The heating lamp 3 is turned off after the detected temperature has reached the set reference temperature, whereupon the detected temperature begins to decline. On the other hand, when the heating lamp 3 is in the off state and the detected temperature approaches the set reference temperature from a higher temperature, the current supplied to the heating lamp 3 is controllably turned on and off for periods of 1 [second]so as to increase power consumption and retard the speed at which the temperature declines. After the detected temperature has equalized with the set reference temperature, the heating lamp 3 is turned on and the detected temperature again is elevated.

The timing for switching the electric current supplied to the heating lamp 3 from the on state to the off state, or from the off state to the on state is accelerated by means of the aforementioned control compared to when the square wave is not added to the temperature detection signal A, as shown in FIG. 3(*b*). Furthermore, the aforesaid switching can be accomplished calmly, with the result that the fluctuation range of the surface temperature of the heating roller 1 is controllably maintained within a narrower range.

Figure 4:
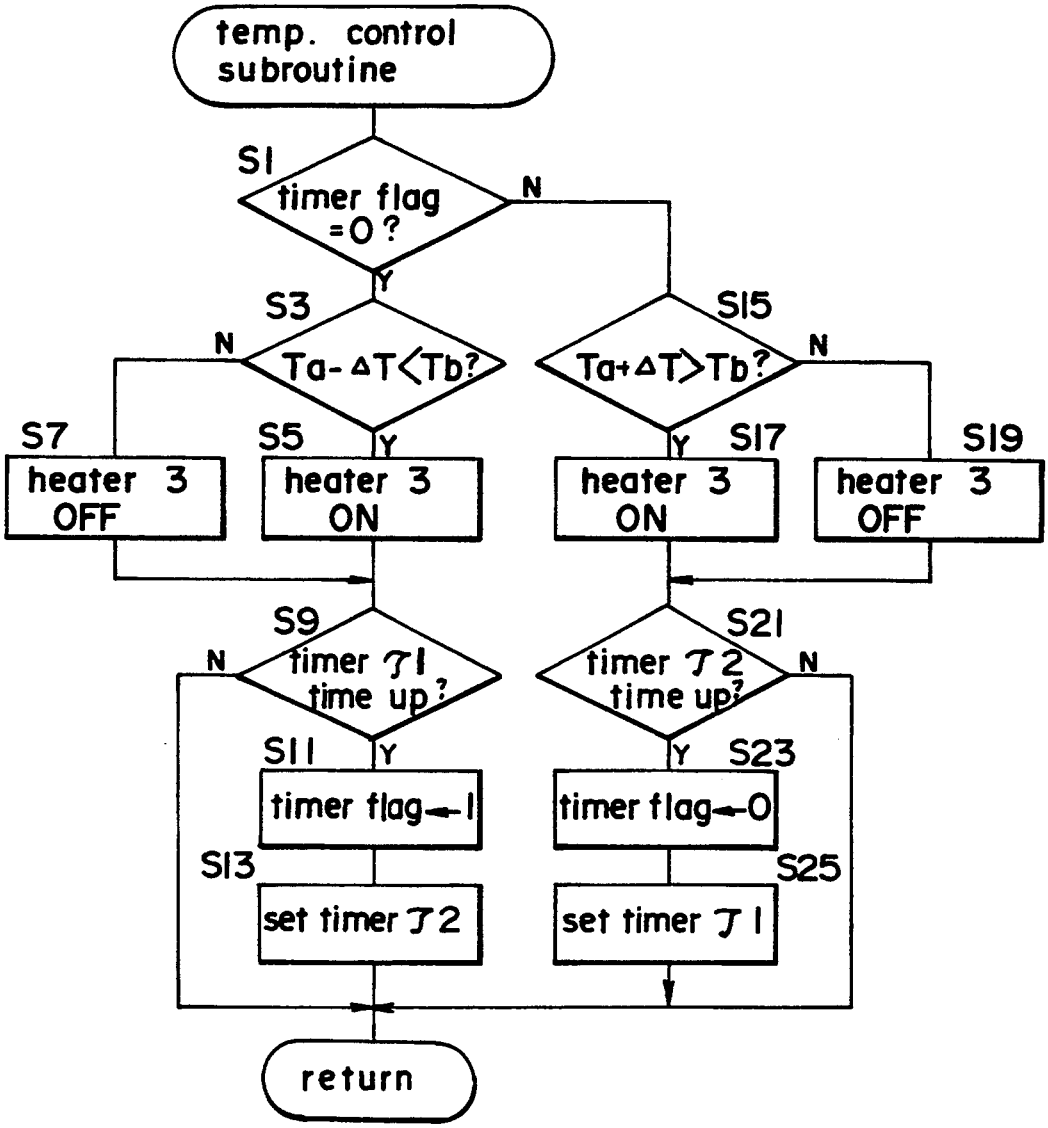
FIG. 4 is a flow chart showing the temperature regulating operation of the fixing device of the present invention.

The temperature control of the heating roller 1 of the present invention is described hereinafter with reference to the flow chart of FIG. 4. First, in step S1, a check is made to determine whether or not the timer flag is set at [0] or [1]. When the timer flag is set at [0], the routine proceeds to step S3, whereas when said flag is set at [1], the routine proceeds to step S15. When the timer flag is set at [0]the timer $\tau 1$ is set to count the timer period 1, whereas when the timer flag is set at [1]the timer $\tau 2$ is set to count the time period $\tau 2$, and the timer flag is changed to either [0]or [1]each time the period of the respective timers has elapsed. In step S3, a check is made to determine whether or not the "$Ta-\Delta T<Tb$." In the aforesaid expression, Ta is the temperature detected by the thermistor 4 and is expressed by the temperature detection signal A in FIG. 2(*a*); Tb is a predetermined reference temperature expressed by the reference temperature signal B in FIG. 2(*a*). In the aforesaid expression, $Ta-\Delta T$ is a value added to the square wave, and is expressed by the temperature detection signal c in FIG. 2(*a*). When the determination of step S3 is that "$Ta-\Delta T<Tb$" is fulfilled, the heater lamp 3 is turned on in step S5, whereas when said determination is that "$Ta-\Delta T<Tb$" is not fulfilled, said heater lamp 3 is turned off in step S7. Then, in step S9, a check is made to determine whether or not the time period $\tau 1$ has elapsed, and if said time has elapsed the timer flag is set at [1](step S11), and the timer $\tau 2$ is set (step S13), whereupon the routine returns. If the time period $\tau 1$ has not elapsed, the routine returns immediately.

In step S15, a check is made to determine whether or not "$Ta+\Delta T>Tb$." When "$Ta+\Delta T>Tb$" is true, the heating lamp 3 is turned on (step S17), whereas when "$Ta+AT>Tb$ is not true, the heating lamp 3 is turned off (step S19). Then, in step S21, a check is made to determine whether or not the timer period $\tau 2$ has elapsed. When the period $\tau 2$ has elapsed, the timer flag is set at [0] (step S23), the timer $\tau 1$ is set (step S25) and the routine returns. On the other hand, when the time period $\tau 2$ has not elapsed, the routine returns immediately.

Figure 5:
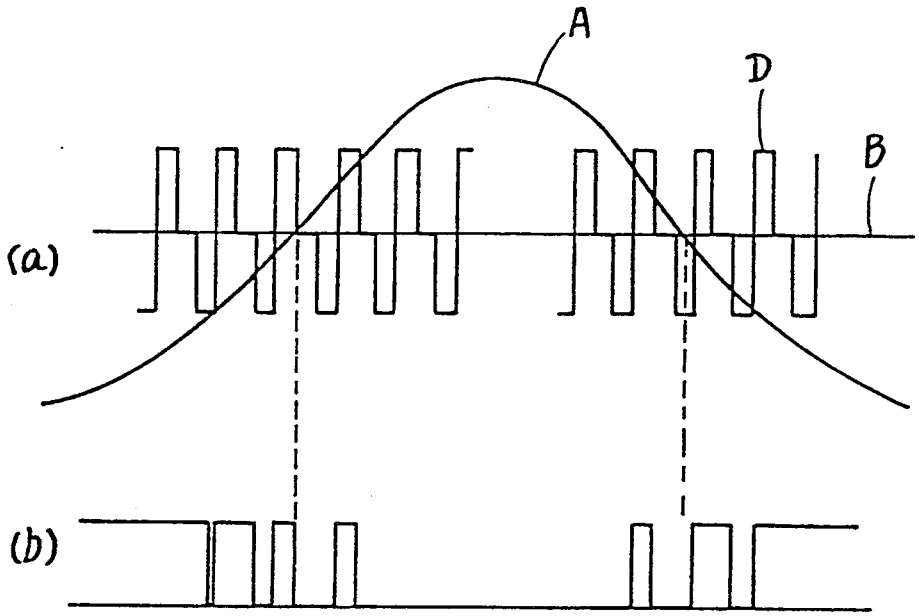
FIG. 5 illustrates another example of the principles of temperature regulation of the fixing device of the present invention.

Although the present embodiment has been described in terms of a square wave having constant amplitude and periodicity added to a temperature detection signal, it is to be noted that the same effect may be accomplished by a periodically variable oscillatory wave signal added to the predetermined reference temperature signal. In such a case, for example, an alternative signal changing levels stepwisely (in this case a three-step variable signal) is added to the predetermined reference temperature signal B and is modified to an amplitude-bearing set temperature signal D to achieve the same control as described in the aforesaid embodiment, as shown in FIG. 5(*a*), and the condition of the electric current supplied to the heating lamp 3 can be more finely controlled, as shown in FIG. 5(*b*), to accomplish switching the current from the on state to the off state more calmly. Furthermore, the same effect may be accomplished even when a periodic amplitude wave is added to both the temperature detection signal and the predetermined reference temperature signal. In such an instance, the periods must be dissimilar.

While a heating lamp was used as the heater 3 provided within the heating roller 1 in the aforesaid embodiment, it is to be understood that a resistance heating element may alternatively be used. And, while a square wave was used as the oscillatory wave added to the temperature detection signal and the predetermined reference temperature signal in the present embodiment, it should be noted that delta waves, sine waves and the like may also be used.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A fixing device for thermally fusing a toner image on a paper by a heating roller and a pressure roller, the fixing device comprising:

heating means for heating the heating roller;

detecting means for detecting the temperature of the heating roller and providing a temperature detection signal;

signal converting means for continuously overlaying a periodically changing signal which is a square wave having a constant amplitude onto the temperature detection signal detected by the detecting means;

comparing means for comparing the modified temperature detection signal which is overlaid with the periodically changing signal by the signal converting means and a predetermined reference temperature signal which is a standard for temperature control, and control means for supplying electric current pulses to the heating means during an operative state which is determined in accordance with the comparison result of the comparing means.

2. The fixing device as claimed in claim 1, wherein said heating means including an heating element to which current is supplied.

3. The fixing device as claimed in claim 2, wherein said heating element is a heater lamp.

4. A fixing device for thermally fusing a toner image on a paper by a heating roller and a pressure roller, said fixing device comprising:

heating means for heating the heating roller;

detecting means for detecting the temperature of the heating roller and providing a temperature detection signal;

signal converting means for continuously overlaying a periodically changing signal which is a square wave having a constant amplitude on a reference temperature signal which is a standard for temperature control;

comparing means for comparing a temperature detection signal detected by the detecting means and the reference temperature signal which is overlaid with the periodically changing signal by the signal converting means, and control means for supplying the electric current intermediately between on state and off state by repeatedly switching on and off the electric current before the electric current is completely turned on or off in accordance with the comparison result of the comparing means.

5. The fixing device as claimed in claim 4, wherein the heating means includes a heating element to which current is supplied.

6. The fixing device as claimed in claim 5, wherein the heating element is a heater lamp.

7. A fixing device for thermally fusing a toner image on a paper by a heating roller and a pressure roller, said fixing device comprising:

heating means for heating the heating roller;

detecting means for detecting a temperature of the heating roller and providing a temperature detection signal;

means for generating a square wave signal;

means for modifying the square wave signal with the temperature signal to provide a temperature control signal;

comparing means for comparing the temperature control signal with a reference temperature signal, and control means for supplying a pulsed electric current to the heating means in response to the comparing means when the temperature control signal matches the reference temperature.

8. The fixing device as claimed in claim 7 wherein the means for generating a square wave is a microcomputer.

* * * * *